US007267460B2

(12) United States Patent
Lefferson

(10) Patent No.: US 7,267,460 B2
(45) Date of Patent: Sep. 11, 2007

(54) ADJUSTABLE BEAMS NIGHT LIGHT

(76) Inventor: Peter Lefferson, 6101 7 Ave. N., Saint Petersburg, FL (US) 33710

( * ) Notice: Subject to any disclaimer, the term of this patent is extended or adjusted under 35 U.S.C. 154(b) by 64 days.

(21) Appl. No.: 10/908,192

(22) Filed: May 2, 2005

(65) Prior Publication Data

US 2005/0243563 A1 Nov. 3, 2005

Related U.S. Application Data

(60) Provisional application No. 60/521,477, filed on May 3, 2004.

(51) Int. Cl.
*F21V 21/00* (2006.01)

(52) U.S. Cl. ..... 362/371; 362/184; 362/187; 362/198; 362/239; 362/250; 362/274; 362/641; 362/644

(58) Field of Classification Search ..... 362/184, 362/187, 371, 641, 644, 653, 654, 198, 239, 362/250, 274
See application file for complete search history.

(56) References Cited

U.S. PATENT DOCUMENTS

| | | | | |
|---|---|---|---|---|
| 5,689,232 | A * | 11/1997 | O'Shaughnessy et al. | 340/468 |
| 6,474,829 | B2 * | 11/2002 | Clodfelter | 362/95 |
| 6,808,289 | B2 * | 10/2004 | Reed | 362/198 |
| 2005/0024863 | A1 * | 2/2005 | Phipps et al. | 362/198 |

* cited by examiner

*Primary Examiner*—Stephen F. Husar
*Assistant Examiner*—Meghan K. Dunwiddie

(57) ABSTRACT

A night light appliance that when plugged into a standard wall electrical outlet provides a means to direct many beams of light to specific places in the room. Extending from the appliance body are bendable arms with bright light emitting diodes mounted at the end of each arm. The plastic body of each light emitting diode contains a lens that forms the light into a narrow beam. This night light is particularly suitable to a conventional bathroom where an electrical outlet is normally found high on the wall and near the sink. Unlike conventional night lights that illuminate the area near the outlet, these light beams can be directed to appropriate places like the doorway, sink, and toilet. It is also useful in a hallway by directing light beams down the length of the hall rather than lighting the area around the electrical plug.

1 Claim, 2 Drawing Sheets

ADJUSTABLE BEAMS NIGHT LIGHT

CROSS-REFERENCE TO RELATED DISCLOSURES

This disclosure claims priority to a first pending U.S. provisional patent application by the same inventor entitled "Adjustable Beam Nightlight" bearing APPL No. 60/521,477, filed May 3, 2004.

BACKGROUND OF INVENTION

1. Field of the Invention

This invention relates to a night light that plugs into a conventional electrical outlet and directs narrow light beams to specific places in a room through the use of bright light emitting diodes at the end of bendable arms.

BACKGROUND OF THE INVENTION

2 Prior Art

Conventional wall outlet plug-in nightlights provide general low level illumination of an area near the wall outlet. Dark bathrooms can be dangerous with potentially slippery floor and many hard surfaces. The bathroom should have specific portions illuminated. For example, the doorway floor, toilet, and sink should be illuminated. Hallways should also be illuminated for much of their full length rather than just in front of a hall electrical outlet.

Conventional night lights use incandescent bulbs and typically consume four (4) Watts of power and have a lifetime of 3000 hours. They are typically turned on with a switch at night. They generate heat that can start fires if they are touching combustible material.

Thus there is a need for a nightlight that can direct light beams to areas and hard surfaces in the bathroom or any room or hallway at night. That night light should consume low power and have a very long lifetime so it can be left on continuously. It should be cool when it is on thus not becoming a fire hazard.

However, in view of the prior art taken as a whole at the time the present invention was made, it was not obvious to those of ordinary skill in this art how all the identified needs could be fulfilled.

SUMMARY OF INVENTION

In one embodiment, the present invention pertains to a night light assembly which plugs directly into an electrical wall receptacle to provide many beams of light that can each be directed along a different path. The assembly comprises a housing having a plug with projecting blades contacts for insertion into a wall receptacle and a projecting array of bendable arms each of which terminates with a light source. Each light source is coupled to a bendable arm and each arm is coupled to the night light assembly. The light beam from each light source can be directed to illuminate an object in the room by adjusting the bendable arms. Each light source may be a light emitting diode. Within the assembly is a suitable power supply circuit to convert the electrical power from the wall receptacle to the appropriate voltage and current which is carried inside the bendable arms to each light source.

DRAWINGS

Reference Numeral

Figure 1:
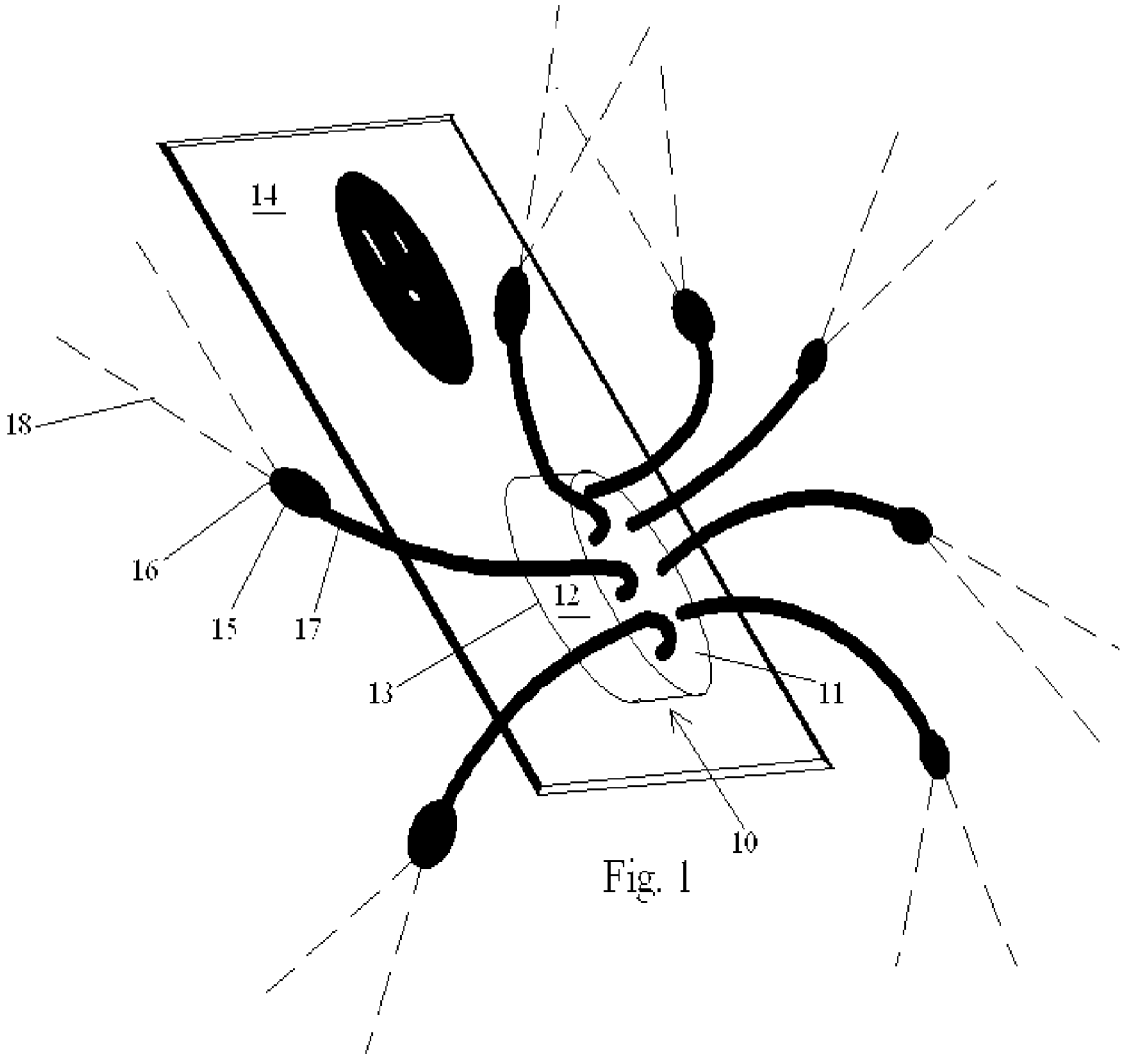
FIG. 1 shows the night light assembly plugged into an electrical wall outlet with an array of bendable arms and with a single or an array of light emitting diodes at the end of each arm.

10. housing
11. front wall
12. side wall
13. back wall
14. electrical outlet
15. light emitting diode (LED)
16. lens
17. bendable arm
18. beams of light
20. toilet
22. power supply
24. outlet plug
26. fuse
28. resistor
30. diode bridge circuit
32. capacitor

DETAILED DESCRIPTION

Referring to FIG. 1, there will be seen an illustrative embodiment of the night light denoted as a whole by the reference numeral 10.

In a preferred embodiment, the novel night light includes a cylindrical housing 10 that has side walls 12 preferably about two inches long and a top wall 11 and bottom wall 13 that are about 1.5 inches in diameter. Such dimensions are not critical. More particularly, housing 10 may be of any predetermined geometrical configuration such as cylindrical, multifaceted, or irregular.

This night light invention illuminates specific portions of a room by sending beams of light 18 from light emitting diodes (LED) 15. The end portion of each LED 15 plastic case is a lens 16 that concentrates the light into a narrow beam. The LED is coupled to the top wall 11 of the housing 10 with a bendable arm 17. The night light is plugged into a conventional electrical outlet 14 using conventional electrical plug prongs (not shown) that extent from the back wall 13 of the night light assembly.

Figure 2:
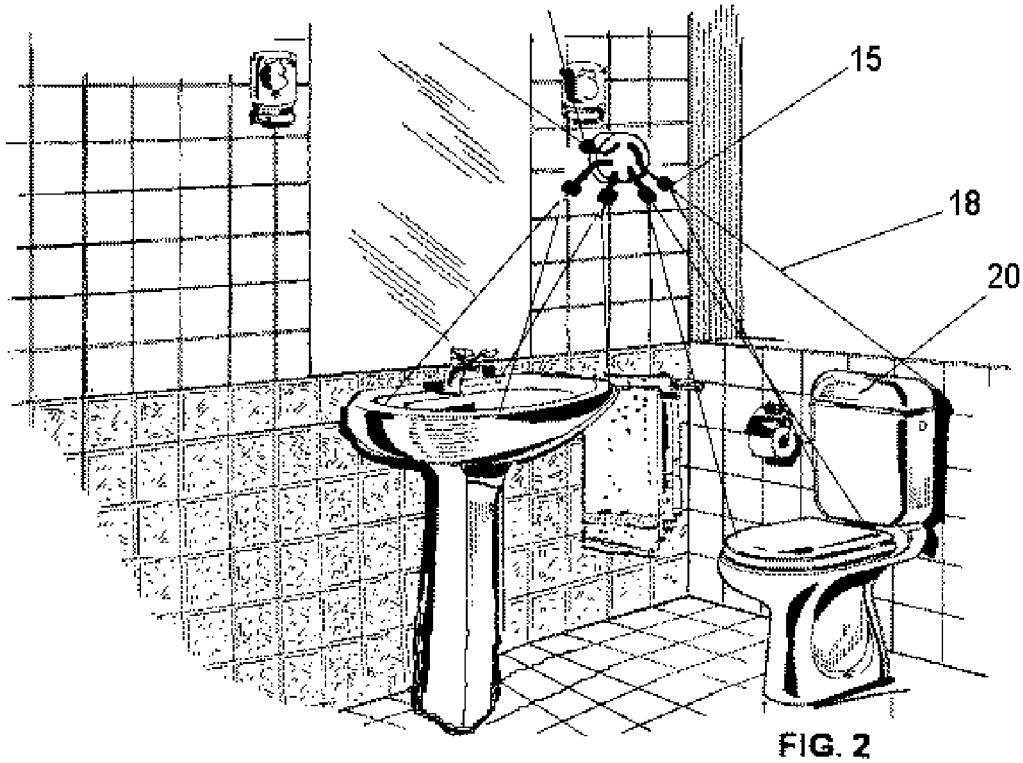
FIG. 2 illustrates the night light used in a bathroom.

FIG. 2 shows the adjustable beam night light mounted on a conventional wall electrical outlet in a bathroom. In this illustration a beam of light 18 is directed from an LED 15 to illuminate a toilet 20. Other beams illuminate other portions of the bathroom.

In one embodiment the LEDs 15 are of the 5 mm diameter standard size that includes a clear plastic lens. The lens 16 forms the light into a narrow beam of 10 degrees between half power points. Other LED sizes or clusters of LEDs may also be used.

In a preferred embodiment blue LEDs are used for bathroom nightlights and green LEDs are preferred for hallway nightlights. Other light colors may be used.

Light sources other then LEDs may be used.

Figure 3:
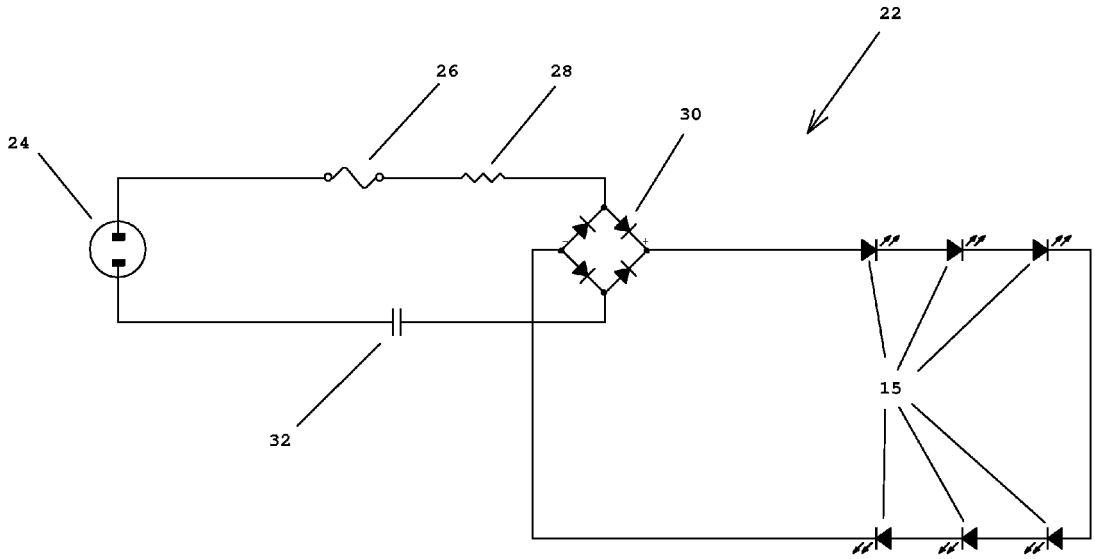
FIG. 3 shows a typical power supply electrical schematic of the night light.

FIG. 3 provides an electrical schematic of a power supply, denoted 22 as a whole, of the night light when it is powered directly from the electrical mains. The electrical outlet plug 24 that is mounted on the back wall 13 of the night light housing 10 receives the household line voltage. Fuse 26 protects the house wiring in case of failure of the current control circuit.

The mains alternating current is converted to direct current through the conventional action of the diode bridge circuit 30. The electrical impedance of capacitor 32 limits the current through the LEDs 15 to that required for the LEDs for proper operation. The resistor 28 limits the initial current surge through the LEDs 10 at the moment when the night light is plugged into a wall outlet.

There are many other electrical circuits suitable for controlling said light sources.

The night light may also be powered by conventional batteries (not shown) in place of the power supply of FIG. 3.

In one embodiment of this night light the bendable arms 17 are made with two no. 18 American Wire Gage insulated solid copper conductor wires (not shown) inside ¼ inch outside diameter vinyl tubing. The LEDs 15 are soldered to these wires (not shown). 5 mm diameter LEDs 15 are firmly attached to the tubing with a standard shrink tubing (not shown) that conforms to the shape of the LED case and to the vinyl tubing. The vinyl tubing is coupled to the front wall 11 of the night light housing 10 through appropriate sized holes and secured with an adhesive. There are many other ways to fashion the bendable arms.

The floor, furniture, and especially bathroom hard surfaces in a room equipped with this novel night light are well-illuminated so that it is safe to walk in at night. This greatly reduces the chances of falling. It also provides the convenience of not turning on the normal bright room lighting when one's eyes are used to the dark. The beams of light provide light on those places one needs to see.

This novel night light will also provide floor lighting in a hallway. Most if not all of a hallway floor can be illuminated by these directed beams of light.

It will this be seen that the objects set forth above, and those made apparent from the forgoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

What is claimed is:

1. A night light, comprising:

(a) A housing of predetermined configuration having a front wall, a back wall, and a side wall interconnecting said front and back walls, (b) said housing having several bendable arms coupled thereon that retains its bent shape after being bent so light beams can be directed to specific objects in the room, (c) a light source coupled to the end of said arms wherein the light source is of the light emitting diode type thus providing improved safety due to light emitting diode well known long operating life and cool operation as compared to conventional 4 Watt incandescent light bulbs that are used in night lights of the present art, (d) a power supply therein to provide power to the light source, (e) a lens coupled to each light source to concentrate the light into a narrow light beam whereby said night light provides beams of light to specific locations in a room for safety and convenience at night, (f) the back containing extended prongs that are appropriate for a conventional wall electrical outlet, (g) a capacitor in series with the alternating current power line with a capacitance value appropriate to provide the reactance necessary to limit the current through the LEDs to a proper value for good illumination from the LEDs, (h) a resistor in series with the alternating current power line with a resistance value appropriate to limit a surge current through the LEDs when the night light is initially plugged into the wall outlet, (i) a diode bridge that receives current from the alternating current power line through the capacitor and resistor and converts this current from an alternating current to a pulsating direct current for the LEDs.

* * * * *